US005230453A

United States Patent [19]

Meschi

[11] Patent Number: 5,230,453

[45] Date of Patent: Jul. 27, 1993

[54] APPARATUS FOR HIGH SPEED OF STACKING EITHER SHEETS OR FORMS AS A CONTINUOUS WEB OR SEPARATED SHEETS WITH TEAR SPLITTING ALONG PREPIERCED LINES

[75] Inventor: Luciano Meschi, Livorno, Italy

[73] Assignee: Industria Grafica Meschi SRL, Livorno, Italy

[21] Appl. No.: 771,137

[22] Filed: Oct. 3, 1991

[30] Foreign Application Priority Data

Oct. 3, 1990 [IT] Italy ..... 21876/90[U]
Mar. 27, 1991 [IT] Italy ..... M191000262

[51] Int. Cl.[5] ..... B26F 3/02; B65H 35/10
[52] U.S. Cl. ..... 225/100; 270/52.5
[58] Field of Search ..... 225/100; 83/99, 260, 83/261; 270/52.5

[56] References Cited

U.S. PATENT DOCUMENTS

| | | | |
|---|---|---|---|
| 3,741,451 | 6/1973 | Parenti et al. | 225/100 |
| 4,131,272 | 12/1978 | Hartnig | 225/100 X |
| 4,397,410 | 8/1983 | Schueler | 225/98 |
| 4,460,350 | 7/1984 | Mittal et al. | 493/412 |
| 4,494,948 | 1/1985 | Teyssier et al. | 493/11 |
| 4,577,789 | 3/1986 | Hofmann et al. | 225/100 |
| 4,946,086 | 8/1990 | Suuronen et al. | 225/100 X |

FOREIGN PATENT DOCUMENTS

| | | |
|---|---|---|
| 0370578 | 5/1990 | European Pat. Off. . |
| 3205801 | 8/1983 | Fed. Rep. of Germany . |
| 1031934 | 7/1963 | United Kingdom . |

OTHER PUBLICATIONS

IBM Technical Disclosure Bulletin, vol. 16, No. 801, Jan. 1974, New York, N.Y., U.S.A., pp. 2629-2630.

*Primary Examiner*—Douglas D. Watts
*Assistant Examiner*—Kenneth E. Peterson
*Attorney, Agent, or Firm*—McAulay Fisher Nissen Goldberg & Kiel

[57] ABSTRACT

Apparatus for the high speed stacking of paper sheets of either a continuous web of an accordion-like folding formation of a continuous web or superimposed separated sheets. A drive brings the paper sheets to a tearing mechanism for tearing the sheets along a prepierced line. Properly spaced portions of either the continuous web or the leading edge of every sheet is diverted to a first or a second stop which can also include a folding station arranged on both opposed sides of a sheet stacking plane. The diverter includes, on each side of the sheets to be stacked, a plurality of compressed air blowing nozzles, connected with a compressed air source so that the continuous web portion or the leading edge of the individual sheets are directed to the predetermined stopping station, and folding station, if necessary. A tear separating device is provided which includes two parallel and superimposed rollers which includes a plurality of cylinders, of which at least the lower cylinders are provided with at least a planar or a bevelled portion, so that when the bevellings face each other, the web freely travels past the rollers and, when the rollers become engaged, the resilient material is prevented from travelling.

20 Claims, 8 Drawing Sheets

APPARATUS FOR HIGH SPEED OF STACKING EITHER SHEETS OR FORMS AS A CONTINUOUS WEB OR SEPARATED SHEETS WITH TEAR SPLITTING ALONG PREPIERCED LINES

BACKGROUND OF THE INVENTION

The present invention relates to an apparatus for high speed stacking of paper sheets or forms. The stacking is provided by the apparatus according to the invention by either accordion-like folding of a continuous web along preset spaced portions thereof or, alternatively, by a simple superimposition of separated sheets.

Such an apparatus is particularly useful both in preparing paper for high speed printers, such as laser printers or the like, as a continuous accordion folded web to provide packages containing a preset number of loops or "forms" connected to each other by transversal prepierced lines, and in the superimposition of said forms coming out from the printer, after they each have been separated from each other by a tear action along the above mentioned prepierced lines.

More specifically, the present invention pertains to the apparatus to effect a tear separation along prepiercing lines preset in the continuous web and defining the single forms or sheets.

Devices for providing this tear separation are already known, and as an example, it is possible to mention the device covered by the utility model Italian patent No. 215262 filed on Nov. 21, 1988.

Devices advantageously solving the problem of providing a continuous accordion-like folded web are already know, as for example those which were the subject matter of the Italian patent applications S. N. 22536 A/88 filed on Nov. 7, 1988 (granted as U.S. Pat. No. 1,227,467) and S. N. 21466 A/89 filed on Aug. 7, 1989 in the name of the present applicant to which reference will be made in the description of the device according to the present invention.

It has been noticed that the devices of the above applications and patents, although are completely reliable for doing the duty entrusted to them, while there were some working problems for what is regarded as the tear separation and the means provided to direct the continuous web portions to one or the other of the stopping and/or fending stations of the end edges of said portions.

Further it has been noticed that the versatility of said devices was limited by the fact that they hardly could be used for stacking loose forms i.e. forms coming out from the printer as a continuous web and separated from each other, for example, by tear separation.

The stacking of the forms separated from each other is not certainly an operation which can be carried out easily because, differently from the continuous web for which there are no specific problems in directing the portions thereof to the stopping and/or folding stations, as the above mentioned web is a continuous piece, said problems are relevant in the case of separated forms either in driving or suitably directing them. It is an object of the present invention to provide an apparatus which can solve the above mentioned problems in an advantageous, simple and reliable way.

It is a more specific object of the present invention to provide a tear separating device useful in a device of the above mentioned kind.

The main object of the present invention is met by a high speed stacking apparatus of resilient material sheets or forms for either an accordion-like folding of a continuous web or a superimposition of seperated sheets each of which is fed by a continuous web and comprises driving means thereof to diverting means of either properly spaced portions thereof or of the leading edge of said sheets to a first or second stopping and/or folding station arranged on two opposed sides of the stacking plane of the sheets, characterized in that between the inlet area of the web to the apparatus and said diverting means are provided directing means of the web associated with driving means and with actuatable means to provide the tear separation of said web along a transversal pierced line, the above mentioned diverting means comprising nozzle means connected to a compressed air source, said nozzle means being able to provide an air blow directed substantially perpendicularly with respect to the paper sheet coming out from the said directing means and downstream with respect to said tear separating means.

In turn, the tear separating device according to the invention in its most general embodiment comprises:

a first cylindrical roller pair facing each other faced and in frictional contact with said sheet, every roller rotating around its own axis at a constant peripheral speed and in contrary directions for driving the paper web along a preset path;

a second cylindrical roller pair, everyone of them being provided with a planar bevel, said bevels facing each other and being spaced with respect to said sheet and having a substantially equal extension, said second pair being arranged downstream with respect to said first pair;

the rollers of said second pair being rotatable on command around their own axes and in contrary directions to carry out at least a complete turn with peripheral speed higher than that of said first pair, said rollers getting in frictional contact with said paper web, in which at least a roller of said second pair comprises a series of cylinders spaced from each and aligned along their axes and said cylinder series comprising at least a central cylinder and lateral cylinders, the central cylinders being staggered in an advanced phase with respect to the lateral cylinders, so that said central cylinders get early in frictional touch with said sheet with respect to the lateral cylinders.

According to another embodiment which is variation of the tear separation device useful in the apparatus according to the invention, the rollers of the first pair are also provided with the bevels or millings above defined for said second roller pair, without having the already mentioned phase staggering feature of the central cylinders with respect to the lateral ones.

According to another preferred embodiment of this variation, the rollers of the second roller pair have a cross-section larger than that of said first pair.

According to a further embodiment of this variation the upstream arranged pair of friction advancement rollers of the paper web is omitted and the rollers of said first pair are moved by a continuous rotation movement.

BRIEF DESCRIPTION OF THE DRAWING

The features and the advantages of the apparatus according to the present invention will result more clearly from the following detailed not limiting specification, which will be made with reference to the enclosed figures of which.

DESCRIPTION OF THE PREFERRED EMBODIMENTS

Figure 1:
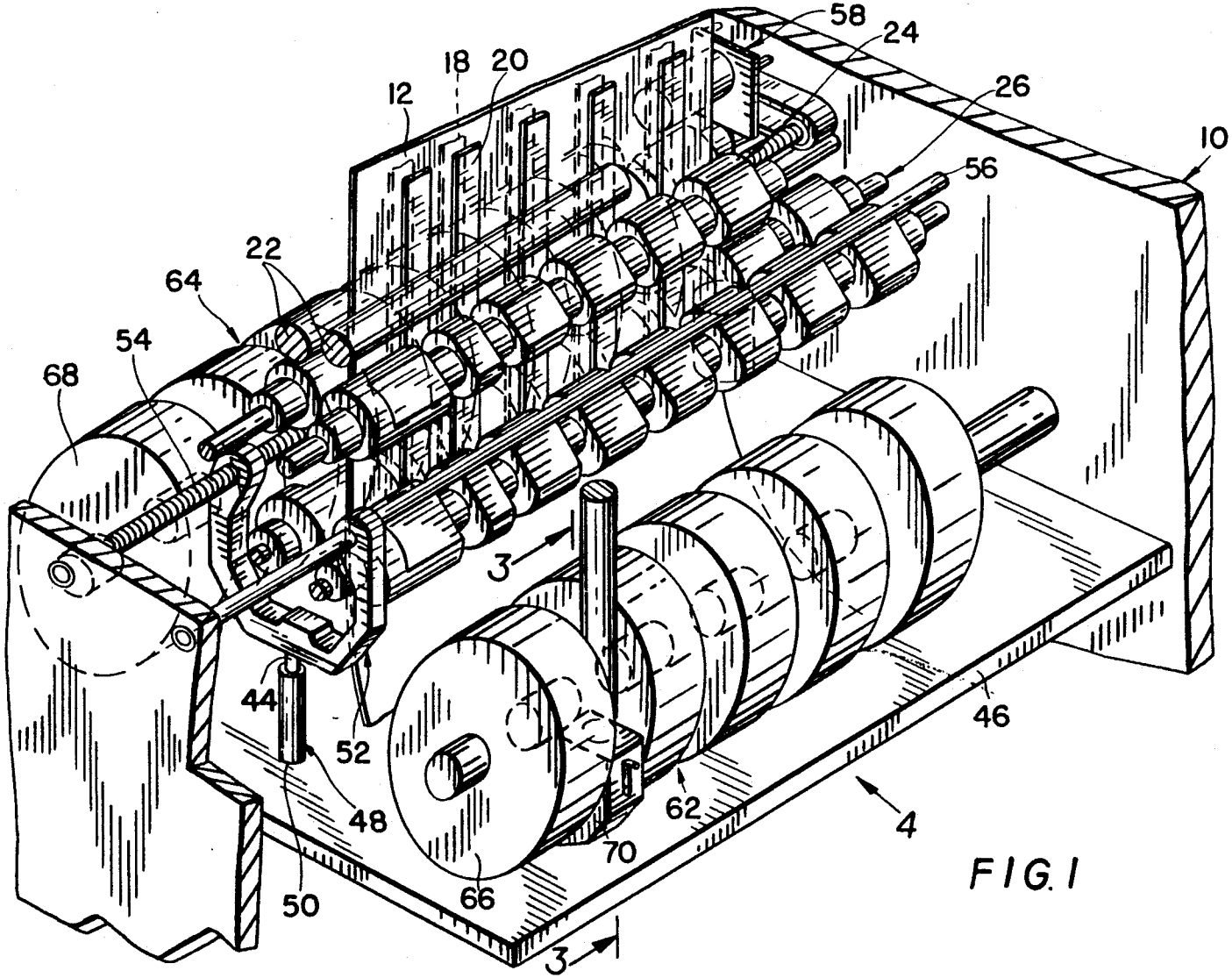
FIG. 1 is a perspective schematical assembly view, with partial breakings, of the apparatus according to the present invention.
Figure 2:
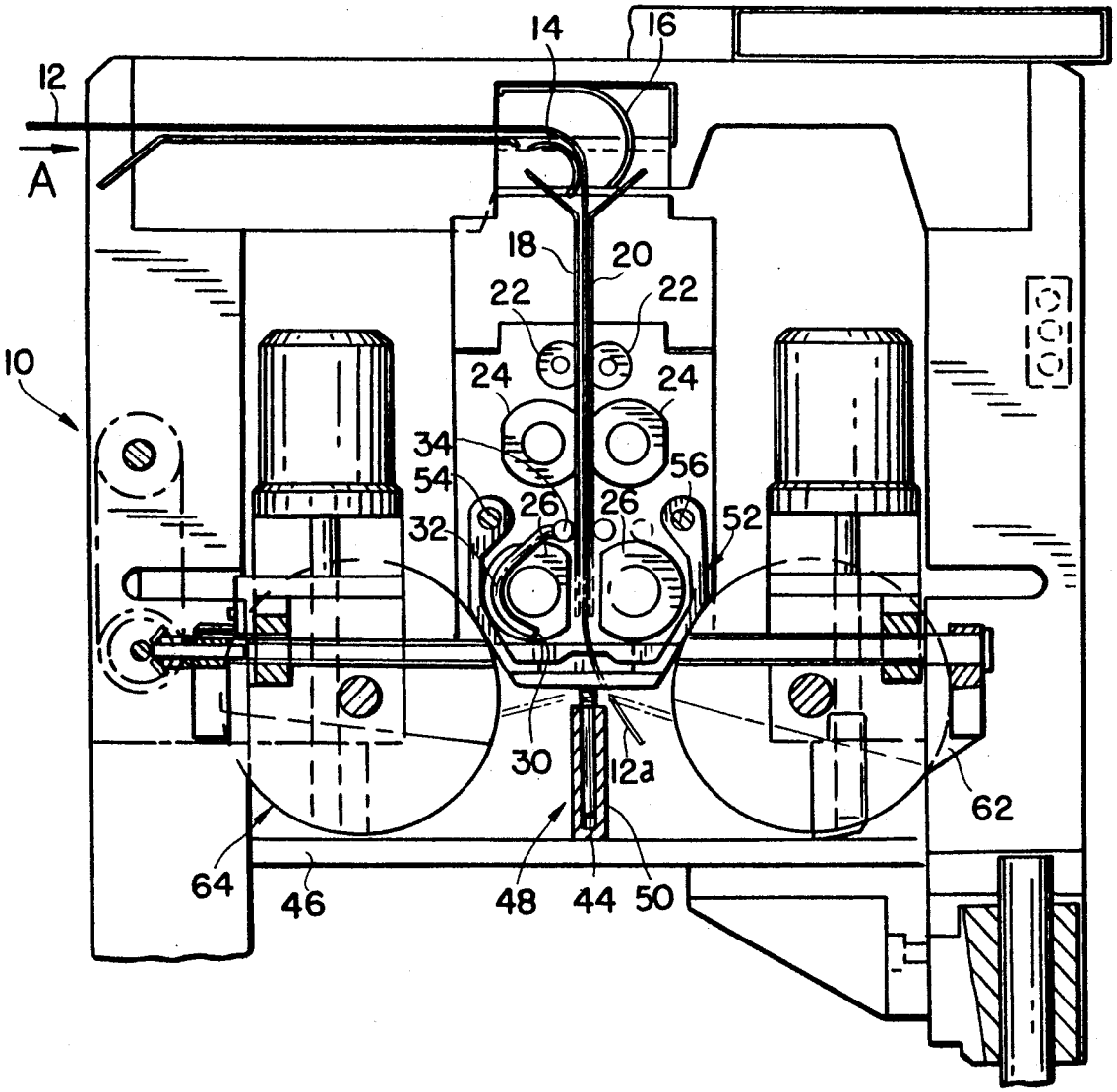
FIG. 2 is a schematical view in side elevation of the apparatus of FIG. 1.

Particularly referring to FIGS. 1 and 2, the apparatus according to the present invention comprises a fixed frame 10 on which the means are arranged for stacking paper sheets in the form of either a continuous web or sheets separated from each other. In the present specification, just as an example, a more specific reference will be made to the stacking of separated sheets, as the same considerations will be valid for the stacking of sheets as a continuous web.

It is however to be noticed that the apparatus is fed at the inlet end for both cases with a continuous paper web 12. This web comes, according to the direction of the arrow A in FIG. 2, for example from a printer (not depicted).

At the inlet of the apparatus there are arranged two essentially semicircular and concentric section bars 14 and 16 (FIG. 2) fastened in a known way to the frame 10, by means of which the web 12 is downwardly directed, thus advancing according to a substantially vertical direction. The length of both the section bars 14 and 16 is equal to the largest possible width of the web 12 fed by the feeding apparatus.

Under the section bars 14, 16 are arranged a first and a second plurality of essentially rectilinear rods 18, 20 of equal length and arranged at the same height. They are fastened in any known way, not depicted, to the frame 10, and are opposed and parallel in pairs and the spacing between the pairs of rods of a series and those of another pair of rods, as well as their width, are predetermined, as it will herebelow explained.

The upper end (underdesignated) of each rod 18, 20 is outwardly bent in order to form a substantially funnel-shaped structure providing an invitation for inserting the web 12 between said rods.

The advancement of the web 12 is caused by a pair of grooved tractor rollers 22 between which the above mentioned web is passed, said cylinders being pivotably supported by the frame 10 and connected to motor means not shown.

Under the tractor rollers 22 means are arranged to effect the tearing of the web 12 along the prepierced lines and said means are either actuated or not according depending on whether it is desired to operate either on separated forms or on a continuous web. These means will be herebelow described having reference to FIGS. 5-11.

As above mentioned, the rods 18, 20 are of predetermined width and properly spaced. That allows to arrange said rods in order to enable them to pass through the grooved portions of the cylinders 22, 24 and 26 and resulting therefore that the rods are very close to each other and thus being a valid guide particularly in the case of operating on separated forms which could be moved from the proper advancing direction just by the operation of the means intended to direct their fore or leading edge to one of the stopping stations, said means causing a displacement crosswise directed with respect to said advancing direction.

With particular reference to FIGS. 1 and 2, an essentially vertical rod 44 provides the side abutment of the sheet package, not depicted, which will be formed on the horizontal stacking plane 46, said abutment being indicated as a whole by the reference 48. The function of the abutment is to maintain the stack sheets vertically aligned, the side edge of which engages the above mentioned abutment. In the embodiment considered as an example in the present description, the abutment 48 is of the kind forming the subject-matter of the Italian utility model patent application S. N. 21875 B/90 filed on Oct. 3, 1990 in the name of the present applicant to which reference is made for understanding the abutment 48 structure. Just to complete the reference, it is to be reminded that the abutment 48, and more specifically the cylindrical body 50 housing the rod 44, is vertically movable with respect to said rod and transversally together with said rod. Particularly, this latter movement is allowed by the connection between the rod 44 and the relating supporting means consisting of a yoke, indicated as a whole by the numeral 52, which is movable along a threaded turnable shaft 54 and a fixed smooth rod 56 by actuation of motor means 58, as disclosed in detail in the above patent application. Analogous abutment means, indicated by the numeral 60, are provided on the opposite side of the sheets to be stacked, as it is clearly seen from the FIG. 1, but contrary to the abutment means 48, are fixed in transversal direction and movable in vertical direction. To direct the sheets to be stacked onto the plane 46, after the tear separation when a continuous and transversally prepierced paper web is fed, there are provided nozzles 30 connected through a shaped duct 32 to a manifold 34 feeding compressed air, which in turn is connected, under the control of a controllable and programmable on-off valve, to a pressurized air source.

Both the on-off valve and the pressurized air source are not depicted and are of conventional type.

Of course, along the manifold 34 a plurality of shaped ducts 32 is provided housed in the hollow spaces separating the single cylinders forming each roller 26.

It is to be noted that, even if not shown in FIG. 2 for sake of drawing clarity a like manifold 36 is symmetrically provided, as well as the shaped duct 32 and the nozzle 30, so that the paper sheet exiting from the guide gap defined by the rods 18 and 20 is struck by a plurality of air blows on either depending on the control and thus on the programming of the on-off valves.

Consequently, the fore leading edge of the sheet is tangentially bent by the above mentioned blow plurality and the sheet is deposited onto the plane 46 with the desired laying and orientation.

As a matter of fact specifically when a tear separation is effected before the deposition and stacking onto the plane 46, the compressed air blows emitted by the nozzles 30 provide a double function.

First, once a tear separation is effected, they cooperate so as to to help the complete coming out of the sheet under the prepierced line along which the tear separation has been effected.

Figure 4:
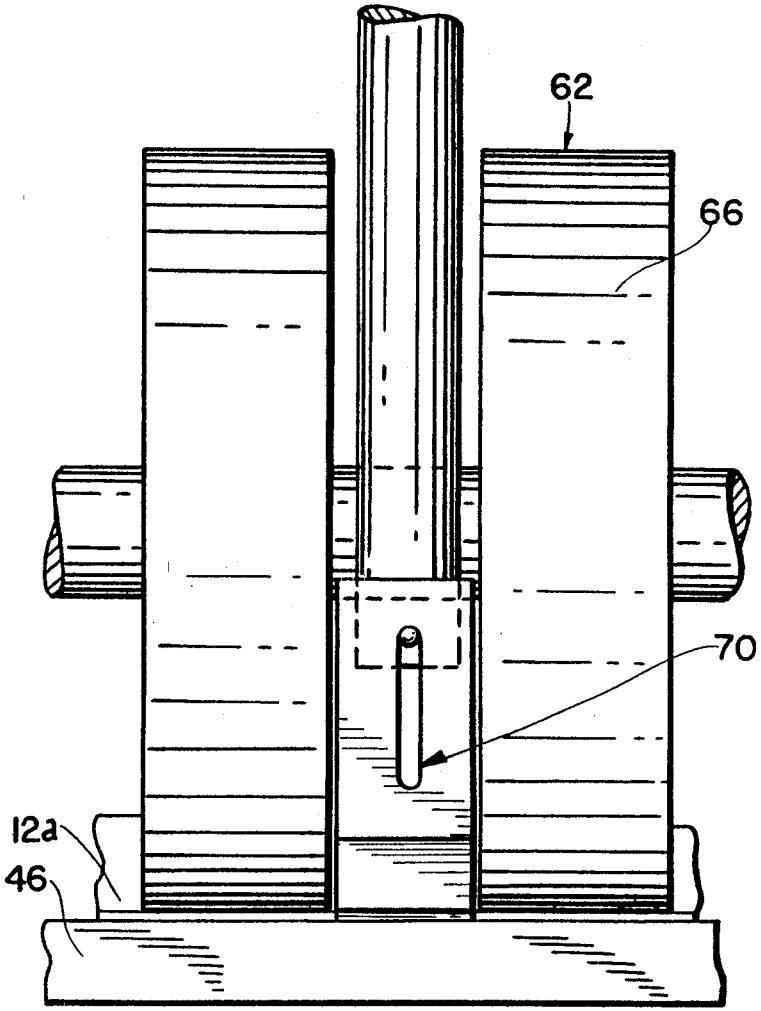
FIG. 4 is a partial view according to the direction of the arrow IV of FIG. 1 of the above mentioned station.
Figure 3:
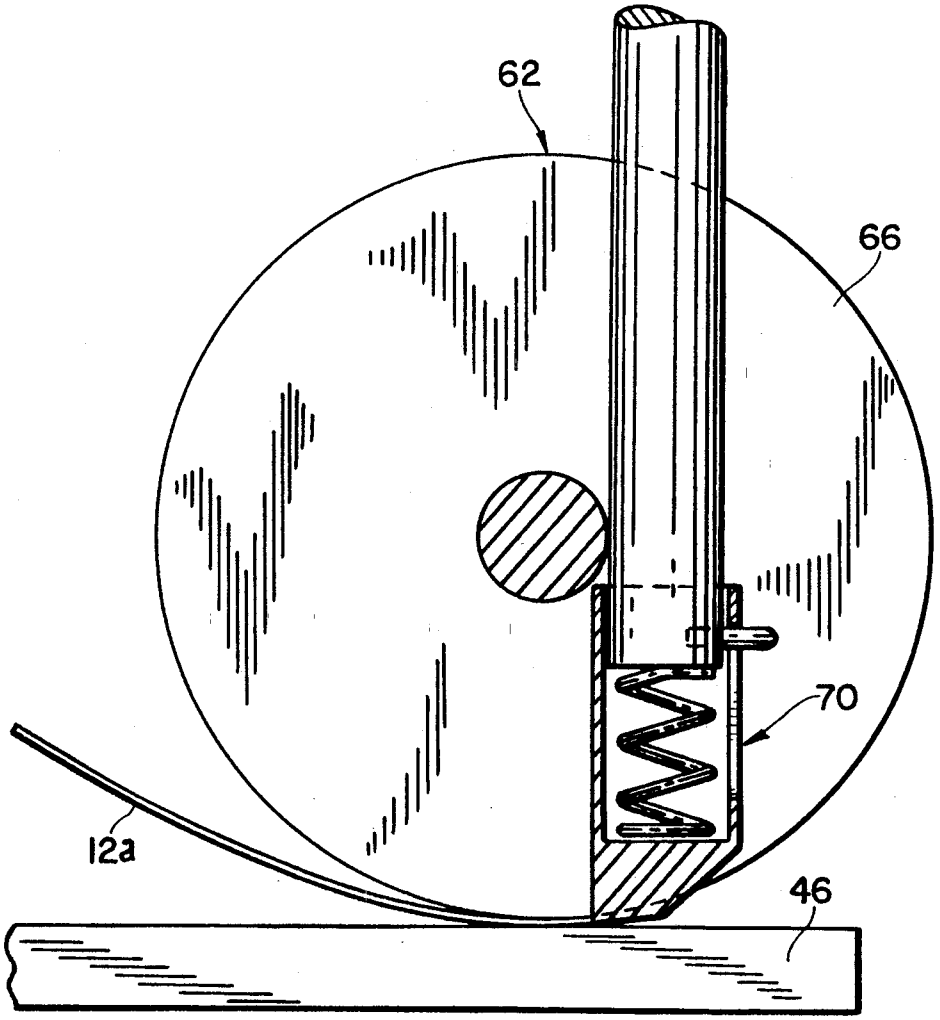
FIG. 3 is a schematical view according to the section III—III of FIG. 1 of one of lateral stopping stations at the beginning of the formation of the sheet package.
Figure 5:
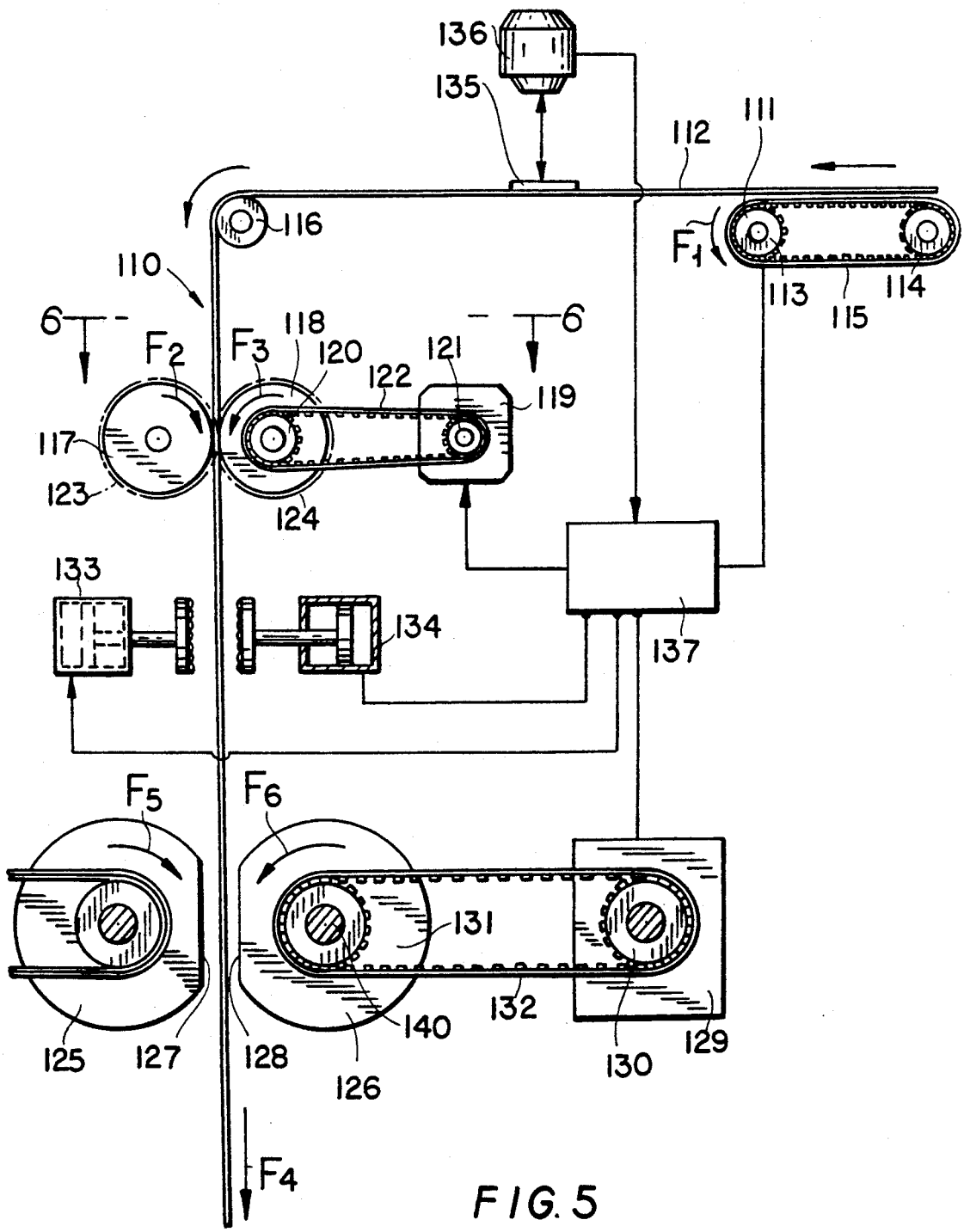
FIG. 5 is a schematical view of the whole tear separating device according to a first embodiment.
Figure 6:
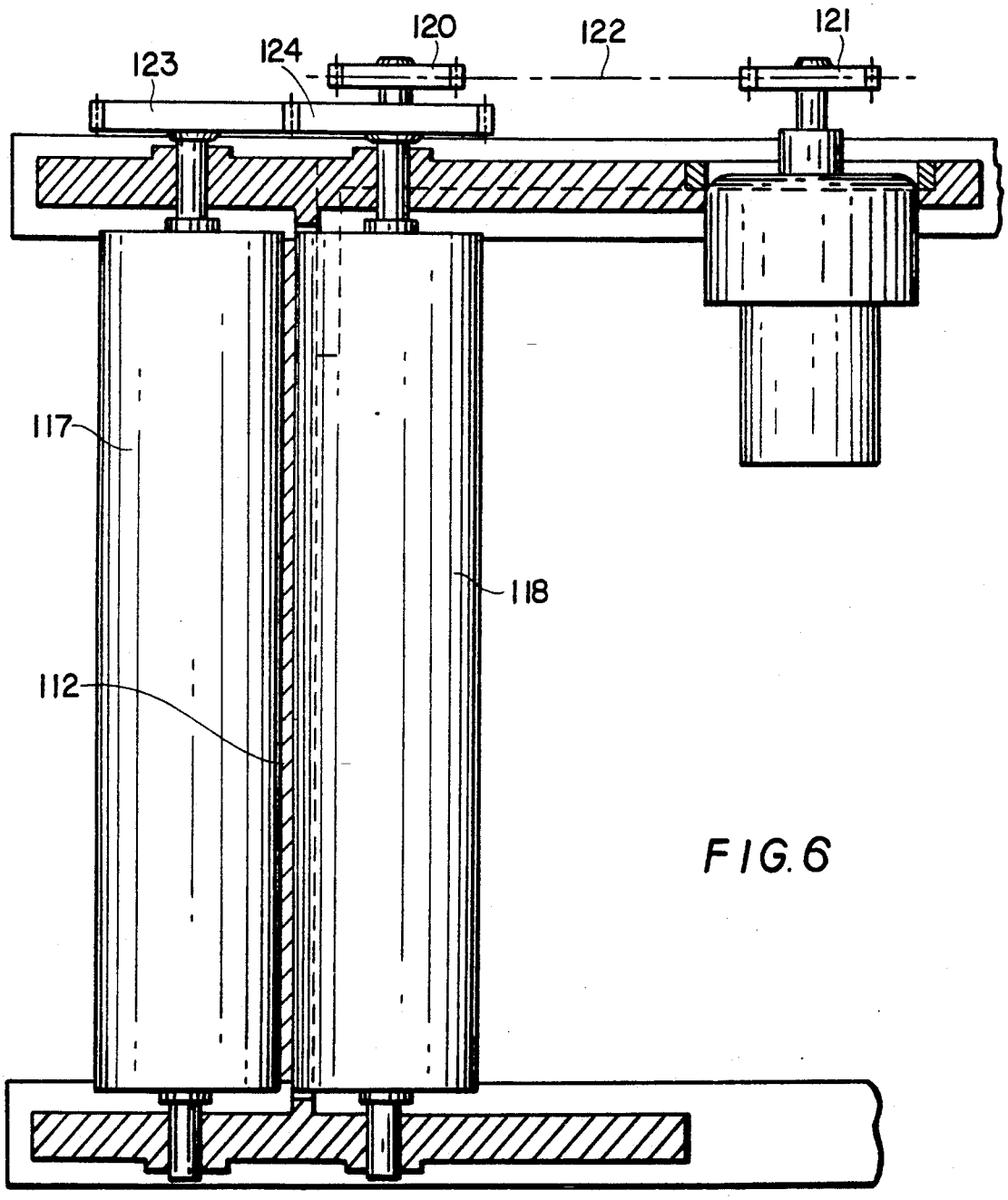
FIG. 6 is a view, partially in cross-section, along the line VI—VI of FIG. 5.

A second immediately subsequent actuation of the blows themselves serves to direct the first exiting sheet in order to deposite it onto the plane 46 with the desired laying. The above mentioned stopping stations are schematically depicted in the FIGS. 1 and 2 and a portion thereof is schematically depicted on an enlarged scale in the FIGS. 3 and 4. Of said stations the right one in the FIGS. 1 and 2 is indicated as a whole by the numeral 62, while the left one of the same figures is indicated as a whole by the numeral 64. Substantially the above mentioned stations comprise a grooved roller 66, 68 (FIG. 1) rotating in substantially opposed direction with respect to the other and which, in the case a continuous web 12 is treated, also provides the folding of the web portion with which is engaged, while in the case of operation on separated sheets maintains the fore edge of said sheet against the collecting plane 46. The stopping means of the above mentioned stations consist of retractable fingers 70, only one of which is depicted in FIG. 1 for reasons of depiction clarity, against which the web or the sheet to be stacked stops. The lower end of the retractable fingers 70 is always getting in touch with the collecting plane 46 as this latter descends as the height of the sheet packages being formed thereon increases. Referring now to FIGS. 5 and 6, it is noticed that the device 110 comprises a tractor 111 for the sheet 112 coming, for example, from the laser printer (not shown). Said tractor consists of driving pulley 113 and a driven pulley 114 connected to each other by a toothed belt 115.

The driving pulley 113 is moved by a synchronous electric motor or the like (not shown) to drive in rotation the belt 115 according to the arrow $F_1$ for advancing the sheet 112 to the snub pulley 116 and a first cylindrical roller pair 117, 118.

The cylindrical rollers 117, 118 are rotated around their own axes as indicated by the arrows $F_2$, $F_3$ by means of an electric synchronous motor 119 to which they are connected through pulleys 120, 121, a toothed belt 122 and gears 123, 124 (FIG. 6). The external surfaces of said rollers are in frictional contact with the paper sheet 112 and have a preset and constant peripheral speed ensuring a little tension of the sheet 112 in the zone between the tractor 111 and the cylindrical rollers 117, 118 in order to avoid undue ripples of said sheet 112.

Downstream with respect to the first cylindrical roller pair 117, 118 there is a second roller pair 125, 126, each of which is provided with a planar bevel 127, 128, being each bevel substantially facing the other and being spaced with respect to the paper sheet 112, so that when the rollers are stopped in the indicated position, the sheet 112 can freely pass between them to continue the motion to a collecting plane (not shown) as indicated by the arrow $F_4$.

The bevelled rollers 125, 126 can rotate on command around their own axes in opposed directions, as indicated by the arrows $F_5$, $F_6$, to make at least one complete turn with a peripheral speed higher than that of the cylindrical rollers 117, 118 so that the surfaces of the cylinders 125, 126 beyond the bevels come in frictional, temporary contact with said paper sheet 112 causing a substantial tensioning on the sheet 112 high enough to produce a tearing at the transversal prepierced straight line in the length of the sheet 112 comprised between the first and the second cylinder pairs.

The rotation of the bevelled rollers 125, 126 is controlled by an assembly 129 comprising an electric motor and a clutch (not shown) by means of pulleys 130, 131, toothed belt 132 and gears (not shown) of the kind suited for rotating the cylinders 117, 118. In the zone comprised between the cylindrical rollers 117, 118 and the bevelled rollers a pliers mechanism 133,134 can been interposed for blocking the sheet 112 in a determined position for a very short time in order to have the tear of the sheet 112 effected along the prepierced straight line which will be located in the length comprised between said pliers 133, 134 and the pair of bevelled rollers 125, 126.

It is clear that lacking the pliers 133, 134 the device operates continuously and it is essential that the peripheral speed of the bevelled rollers 125, 126 be higher than that of the cylindrical rollers 117, 118 while in the presence of said pliers 133, 134 the device operates discontinuously and the peripheral speed of the rollers 125, 126 must not be necessarily related to the peripheral speed of the cylindrical rollers 117, 118, since the latter are not cooperating with the tear function, but carrying out a tensioning operation on the sheet 112 in the length comprised between the tractor 111 and said rollers 117, 118. As it will be noticed in FIG. 5, on an edge of the sheet 112 preferably a "mark" 135 is impressed, usually a black not reflecting rectangle, or also of some other kind, located at a preset spacing from the preceeding weakening transversal straight line of the sheet 112; on said "mark" a detector 136 is located which in the case of a not reflecting "mark" can be a reflection photoelectric device receiving a signal at the passage of said "mark" and a different signal when the "mark" is away.

The detector 136 is electrically connected to an operating unit 137 to which it sends signals corresponding to those received, said operating unit consistently controlling respectively the synchronous motor 119 and the electric motor-clutch assembly 129 for moving the first roller pair 117, 118 and the second roller pair 125, 126 (in the case the pliers 133, 134 are lacking); on a contrary case, in the presence of said pliers 133,134, the operating unit further controls the movement of the pliers themselves and the corresponding temporary stopping of the tractor 111.

Figure 7:
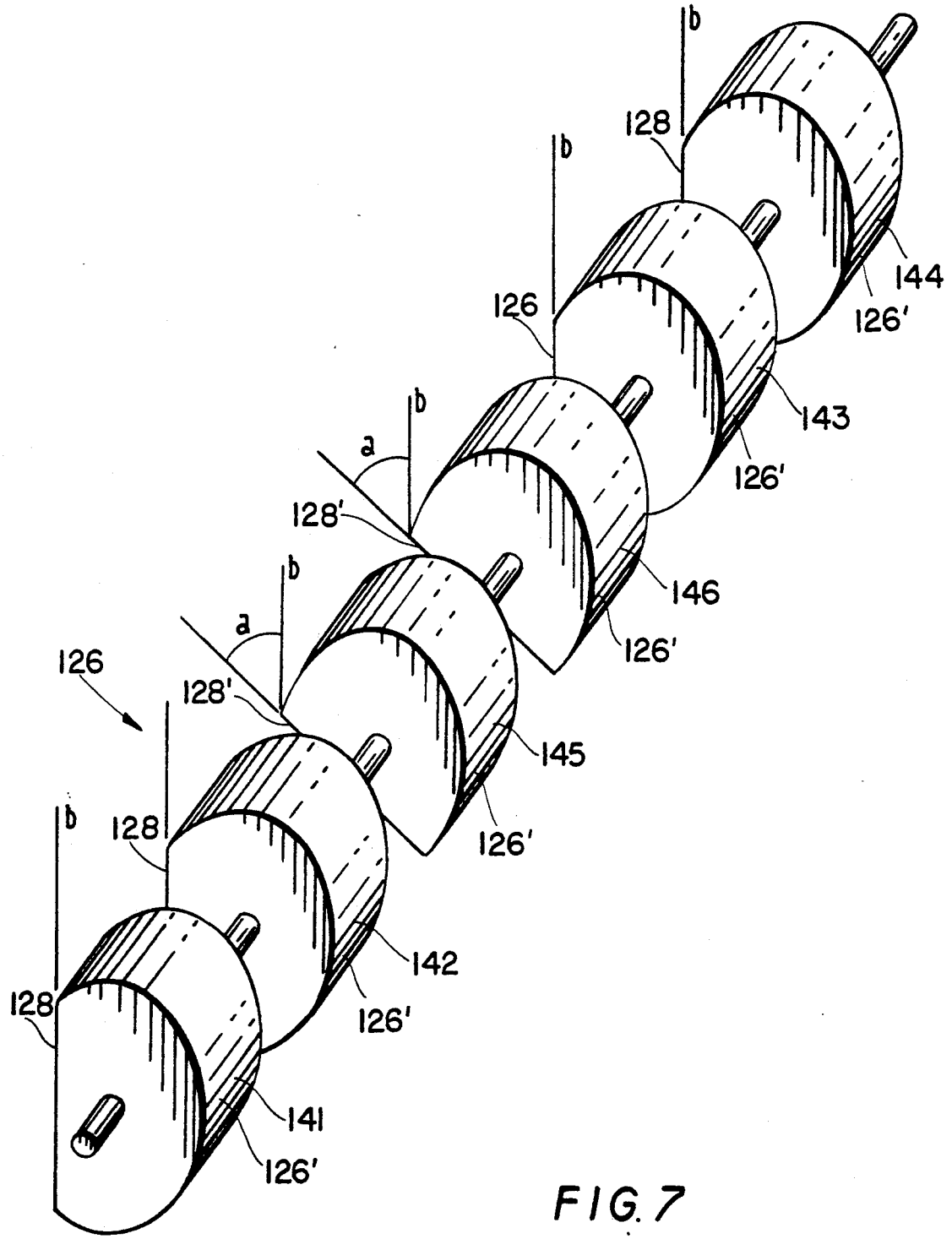
FIG. 7 is an assonometrical depiction of a roller of the second pair.

Looking more in detail at the bevelled roller 126 and referring to the FIG. 7, it is to be noticed that the roller is divided in a series of cylinders 126' spaced from each other and aligned along its axis or shaft 140. Said cylinders 126' comprise lateral cylinders 141, 142, 143, 144 and central cylinders 145 and 146.

While the lateral cylinders have the bevel 128 oriented according to the vertical line "b" substantially parallel to the paper sheet 112 passing between the two rollers 125, 126 of the FIG. 1, the cylinders 145, 146 of equal size have their own bevel 128' stagged in advance by an angle "a".

The same features are found on the opposed roller 125. In the configuration here above described and depicted in FIG. 7, it is easy to understand that the central cylinders 145, 146 of the roller 126 upon rotating around the axis 140 will come in touch with the opposed cylinders of the roller 125 in advance with respect to the lateral cylinders 141, 142, 143, 144 of the roller 126 with the opposed cylinders of the roller 125.

In such a way a tension strain will be provided firstly on the paper sheet 112 at the central area and subsequentely at the lateral areas. Thus the tear beginning of the tear of the sheet 112 will occur in the central area thereof, then extending to the lateral areas. Suitably the advance staggering angle "a" of the central cylinders 145, 146 is not less than 5° and preferably is comprised between 5° and 10°.

With an angle less than 5° there are no appreciable results because the tearing might also begin laterally depending on the weakening variability along the transversal straight line, on the position variability with respect to the tear rollers, on the kind of paper being used and on other possible practical troubles.

With an angle "a" more than 10° a possibly excessive impact differential might occur in the central area, so that the tear begun in the central area would propagate in the lateral areas in an insufficient harmonic way with troubles for the tear itself.

Figure 8:
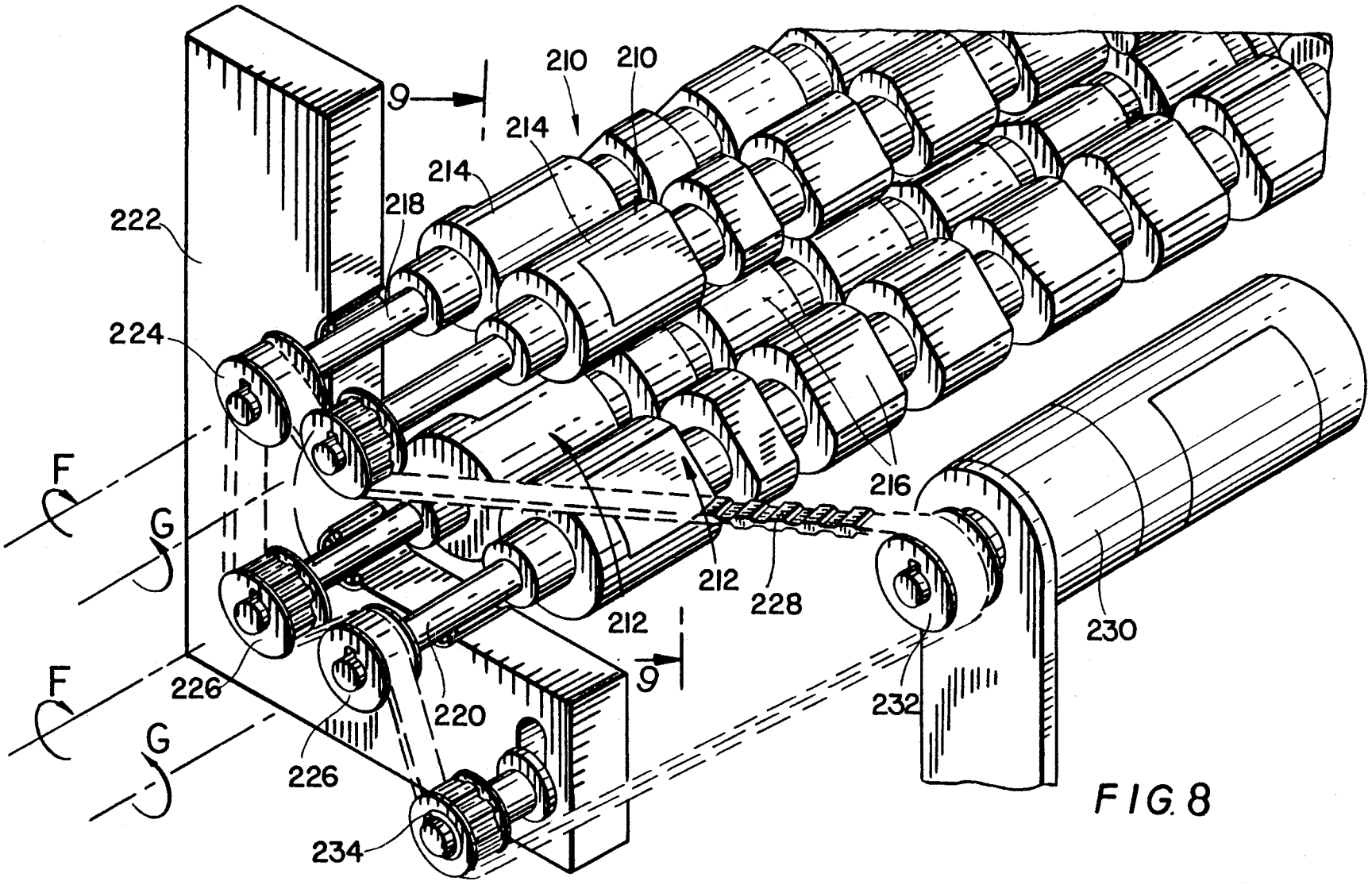
FIG. 8 is a perspective, schematic, partial view of an embodiment variation of the tear separation device.

Referring to FIGS. 8–11, a further variation of the tear separation device is shown. In this connection, as well as in connection with the FIGS. 5, 6 and 7, it is to be emphasized that the representations provided in the FIGS. 5 and 8 are highly simplified with respect to that of FIG. 1 and different reference numerals have been provided to avoid confusion. As shown in the FIG. 8, the separation tear device comprises two pairs of counterrotating rollers 210,212 as indicated by the arrows F and G, each consisting of a plurality of cylinders 214,216 opposed to each other and mounted or formed on shafts 218, 220 and rotatable on a fixed support frame 222.

At the ends of the shafts 218, 220 gears 224, 226 are mounted which are driven into rotation by a toothed belt 228 which is connected by just one driving motor 230 engaging a gear 232 fastened on the shaft thereof. The numeral 234 indicates a transmission gear which is locked in a position which can be changed on the frame 222 to maintain in tension the tooted belt 228.

As the diameters of the gears 224 and 226 are equal, the rotation speed of the shafts 218 and 220 will be the same.

Figure 11:
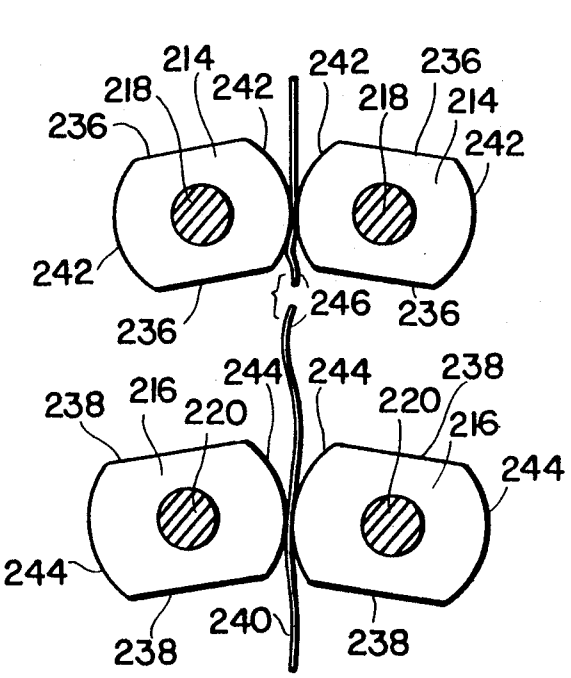
FIG. 11 is a schematical view of the apparatus depicting the tear phase.
Figure 10:
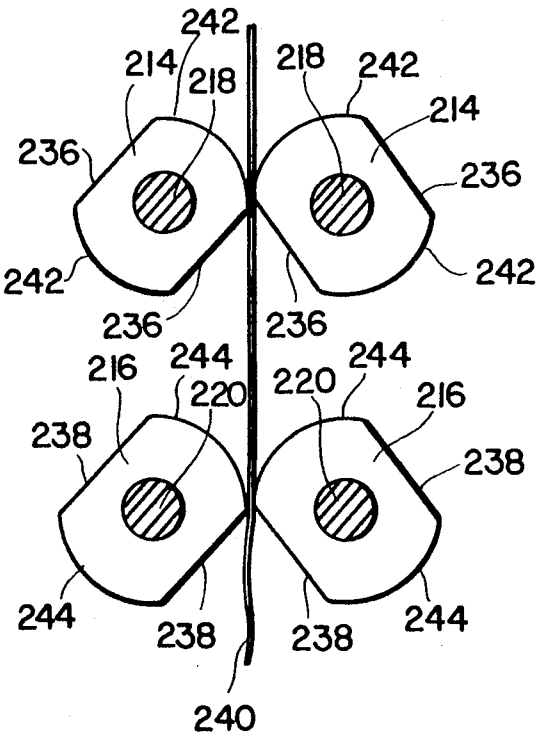
FIG. 10 is a schematical view of the apparatus according to the same cross-section and at the beginning of the sheet tensioning.
Figure 9:
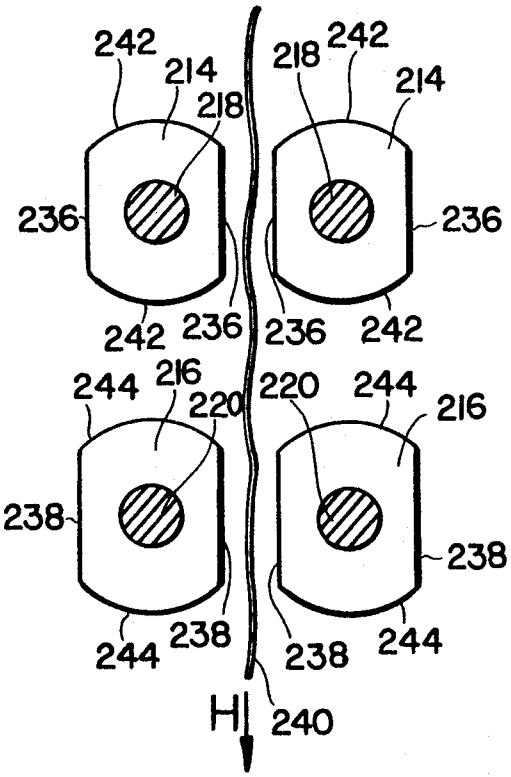
FIG. 9 is a schematic view of the apparatus according to the cross-section IX—IX of FIG. 8 in its rest condition.

Referring now also to FIGS. 9 to 11, both cylinders 214 and 216 have two planar faces 236 and 238 substantially parallel to each other which, when are opposed in the rest position of the apparatus depicted in FIG. 8, define a passage for the paper sheet, indicated by the numeral 240, advancing according to the direction of the arrow H. The paper sheet 240 has, at a present and constant distance, of each other transversal prepierced lines permitting the tear along them when one of them comes between the roller pairs 210, 212 and the cylinders 214, 216 are with engaged each other by rotation so that they come into frictional contact with the paper sheet 240. Each of the portions of the cylinders 214, 216 which engage with friction the paper sheet 240 consists of a convex portion 242, 244 comprised between the planar faces 236, 238 of the cylinders 214, 216. As it is particularly seen in the FIGS. 9 to 11, according to a basic feature of the device, the cylinders 216 which are downstream with respect to the advancing direction of the paper sheet 240 have a cross-section larger than that of the cylinders 214 which are upstream with respect to the same direction. As the rotation speed of the shafts 218, 220 is the same, the peripheral speed of the convex portions 244 of the cylinders 216 will be higher than that of the convex portions 242 of the cylinders 214. In such a way, when the drive motor 230 is actuated to drive into rotation the cylinders 214, 216 so as to bring them into the positions of the FIGS. 10 and 11, the paper sheet portion 240 located between the above mentioned cylinders undergoes such a tensioning action to cause the tear of the sheet 240 along its transversal prepierced line 246, as schematically depicted in the FIG. 11.

Once the above mentioned tear is effected, the cylinders 214, 216, by still rotating according to the arrows F and G, will return in the position of FIG. 9 in order to allow a new advancing of the paper sheet 240 until the subsequent prepierced line 246 will be positioned between the above mentioned cylinders. The latter will be rotated again to cause a further tear of said paper sheet 240. The now described cycle is repeated for every prepierced line 246 of the paper sheet.

According to a further embodiment based on the embodiment of the FIGS. 8–11, upstream of the tear separation device, i.e. upstream of the cylinders 214, the friction roller pair indicated by the reference 22 in FIG. 2 is omitted. At the same time, the shafts 218 are no longer directly kinematically connected to the shafts 220 but continuously rotated by proper motor means, so that the cylinders 214 also fulfill the function of traction of the continuous paper web 240 (i.e. 12 in FIG. 2). However, the presence of the bevels 236 will cause an intermittent advancing of the continuous paper web to take place, which momentarily stops everytime the bevels 236 face each other. The operation of the apparatus, apart from the operation of the tear separation device according to the invention, is the following one.

The web 12 is fed to the apparatus and, after having been diverted downwardly by the section bars 14, 16 is advanced by the rollers 22 to the tear means 24, 26 which can be either actuated or not. Preliminarily, it has been provided to set the posion of the abutment 48 depending on the web 12 width.

In this advancing phase the above mentioned web is guided by the rods 18, 20. By supposing that the tear separation device has been activated when the fore edge **12*a* of the form begins to substantially protrude below the tear separation device the compressed air blows through the nozzles 30** are made operative (of course at the proper side in order to have the paper sheet bend towards the desired side).

It is sufficient the emission of an instantaneous or very short time blow, as continuing the downwardly advancement of the sheet, the latter takes the desired laying i.e. the edge has taken a loop shape of such a length to allow, owing to the advancing speed of the form, to reach the right stopping station 62. At this point, as mentioned, the blow emission is interrupted so that the form can extend by gravity and owing to its own resilience, and take the rest position onto the collecting plane 46.

This operation is cyclically repeated for all subsequent forms till the desired number of forms is stacked.

The succession of the several operating phases can be controlled and set by proper programming means per se known and thus not depicted.

The advantages obtainable by the apparatus of the present invention are apparent from what above written and by the way the main advantages have been already pointed out.

I claim:

1. Apparatus for high speed stacking and cutting of resilient materials including a plurality of definitive sheets, comprising:

frame means and stacking plane means proximate to said frame means;

web tractor means coupled with said frame means at an inlet end of said apparatus for moving said resilient materials in an advancing direction through said apparatus and including means engaging edges of said resilient materials;

web guide means associated with said tractor means for guiding said resilient materials to said stacking plane;

tear separation means actuatable to effect a tear separation of each of said definitive sheets of said resilient materials along a transverse prepierced line, said tear separation commencing between the edges of each of said definitive sheets and extending to the edges of each of said definitive sheets along said prepierced line to form two separate resilient pieces of material; and diverting means for guiding the two separate pieces of resilient material from said guide means, downstream of said tear separation means, and including air pressure means for laying the two separate pieces of resilient material onto said stacking plane means.

2. The apparatus of claim 1, in which said resilient materials are formed in an accordion-like folded material of a continuous web; and said web tractor means in said advancing direction diverts a leading edge of said sheets to a stopping and folding station means;

said tear separation means effecting a tear separation of said continuous web of the accordion-like folded material along said transverse prepierced line; and said diverting means and said air pressure means comprises nozzle means connected to a pressurized air source, said nozzle means emitting an air blow directed substantially perpendicularly to a plane of a paper sheet forming said continuous web exiting from said web guide means.

3. The apparatus according to claim 2, wherein said web guide means includes a first and a second series of rods parallel to each other extending along the advancing direction of said continuous web, and rods of said first series of rods being opposed to rods of said second series of rods.

4. The apparatus according to claim 3, wherein said web tractor means includes rollers having grooved portions and said rods pass through said grooved portions.

5. The apparatus according to claim 3, wherein said rods have upper diverting ends extending outwardly with respect to corresponding ends of said rods and forming a substantially funnel shaped structure to facilitate entrance thereinto of the web between said rods.

6. The apparatus according to claim 2, wherein said tear separation means comprises:

a first pair of cylindrical rollers supported by said frame means, said rollers facing each other and being juxtaposed to each other for frictional contact with said web of sheet material as said web of sheet material passes between said rollers, each said roller rotating around its own axis at a constant peripheral speed, and said rollers rotate in an opposed direction to each other for movement of said continuous web along a preset path;

a second pair of cylindrical rollers supported by said frame means facing downstream of said first pair of rollers, each of said second pair of rollers having a planar bevel, said bevels facing each other in at least one position thereof and being spaced from each other with respect to said web and having a substantially equal extension, means for rotating said second pair of rollers around their own axes and in opposed directions to each other for making at least one complete turn and said second pair of rollers each having a peripheral speed higher than that of said first pair of rollers;

at least one roller of said second pair of rollers comprising a series of cylinders each axially spaced from each other and aligned along their own axes, said cylinder series comprising at least one central cylinder and a pair of outer cylinders on each side of said central cylinder, said cylinder series each having bevels, and the position of said bevels of said central cylinders being angularly displaced from the position of the bevels of said outer cylinders so that said central cylinder of each said series of cylinders comes into frictional contact with said web in advance with respect to said lateral cylinders of each said series of cylinders.

7. The apparatus according to claim 6, wherein said central cylinders are less in number than said lateral cylinders and are staggered relative thereto, and said bevels of said central cylinders are angularly displaced from the bevels of said lateral cylinders by at least 5°.

8. The apparatus according to claim 6, wherein the bevel of each said central cylinder is angularly displaced from the bevel of each said lateral cylinder by an angle that varies between 5° and 10°.

9. The apparatus according to claim 2, wherein:

said nozzle means is positioned close to and below said tear separation means and at the lower end of said guide means; and said nozzle means includes a plurality of nozzles aligned along a line parallel to the advancing plane of the continuous web, each said nozzle being connected to a common manifold through a shaped duct.

10. The apparatus according to claim 9, wherein said tear separation means includes rollers comprising a plurality of spaced cylinders having a hollow space therebetween, and each said shaped duct is housed in the hollow spaces between adjacent cylinders.

11. The apparatus according to claim 1, wherein said tear separation means for effecting the tear separation comprise:

two pairs of counter-rotating cylinder rollers in series along said advancing direction of the resilient materials;

said cylinders each having at least one planar area and in at least one position of each said pairs of counter-rotating cylindrical rollers being axially aligned to have said planar areas opposed to each other for delimitating passage of said resilient materials; and at least a convex portion of one roller of each of said pairs of rollers engaging said resilient materials with the corresponding convex area of the other roller of said pairs of rollers, said downstream cylinders in the advancing direction of said resilient materials having a cross-section larger than that of the cylinders upstream of the advancing direction.

12. The apparatus according to claim 11, wherein the two rollers of each said roller pairs are driven at the same rotational speed and said rollers downstream of said advancing direction are driven at the peripheral speed higher than the peripheral speed of which said upstream rollers are driven so that the convex areas of the downstream rollers is higher than the convex areas of the upstream rollers.

13. The apparatus according to claim 11, wherein said upstream rollers are located with respect to said downstream rollers such that the pairs of rollers of the related cylinders come simultaneously into contact through their convex faces with said resilient materials, and the tear of the resilient materials along said prepierced line occurring in response to the difference in peripheral speed between the upstream and downstream cylinders.

14. The apparatus according to claim 11, wherein said upstream and downstream cylinders include rollers each having at least two planar areas substantially parallel and arranged at 180° to each other and at least two convex areas symmetrical with respect to said planar areas and positioned at 180° to each other.

15. The apparatus according to claim 11, including a single motor means for actuating said two roller pairs.

16. The apparatus according to claim 11, wherein said upstream rollers are driven into continuous rotation such that an intermittent advancement of the resilient materials is induced in the web coming freely to the inlet of the apparatus free of intermediate pulling mechanisms.

17. The apparatus according to claim 1, including nozzle means and means for operating said nozzle means for feeding compressed air every time a tear operation is effected and said operation means comprises two subsequent and timed emissions of a compressed air blow.

18. The apparatus of claim 1, in which said resilient materials are formed from separated paper sheets, and including:

stopping means including retractable fingers against which each of said separated sheets are stopped;

said web tractor means includes means for diverting the leading edge of said separated sheets to said stopping means; and said diverting means and said air pressure means comprises nozzle means connected to a pressurized air source, said nozzle means emitting an air blow directed substantially perpendicularly to the plane of the paper sheet exiting from said guide means.

19. Apparatus according to claim 18, wherein said nozzle means is positioned close to and below said tear separation means and at the lower end of said guide means and comprises a plurality of nozzles aligned along a line parallel to the advancing plane of the paper web, each said nozzle being connected to a common manifold through a shaped duct.

20. The apparatus according to claim 19, wherein said tear separation means includes rollers comprising a plurality of spaced cylinders having a hollow space therebetween, and each said shaped duct is housed in the hollow spaces between adjacent cylinders.

* * * * *